US008098855B2

(12) United States Patent
Lee et al.

(10) Patent No.: US 8,098,855 B2
(45) Date of Patent: Jan. 17, 2012

(54) FLEXIBLE ELECTRET ACTUATORS AND METHODS OF MANUFACTURING THE SAME

(75) Inventors: Chih-Kung Lee, Taipei (TW); Wen-Ching Ko, Kaohsiung (TW); Jia-Lun Chen, Tainan (TW); Wen-Hsin Hsiao, Longtan Township (TW); Wen-Jong Wu, Taipei (TW)

(73) Assignee: National Taiwan University (TW)

( * ) Notice: Subject to any disclaimer, the term of this patent is extended or adjusted under 35 U.S.C. 154(b) by 164 days.

(21) Appl. No.: 12/186,730

(22) Filed: Aug. 6, 2008

(65) Prior Publication Data

US 2010/0215197 A1 Aug. 26, 2010

Related U.S. Application Data

(60) Provisional application No. 61/035,300, filed on Mar. 10, 2008.

(30) Foreign Application Priority Data

Jan. 4, 2008 (TW) ..... 97100279 A

(51) Int. Cl.
*H04R 25/00* (2006.01)

(52) U.S. Cl. ..... 381/191

(58) Field of Classification Search ..... 381/191
See application file for complete search history.

(56) References Cited

U.S. PATENT DOCUMENTS

2009/0060233 A1* 3/2009 Liou et al. ..... 381/191

* cited by examiner

*Primary Examiner* — Alexander Ghyka
*Assistant Examiner* — Stanetta Isaac
(74) *Attorney, Agent, or Firm* — Lowe Hauptman Ham & Berner, LLP

(57) ABSTRACT

A flexible actuator comprises a thin film and at least one first enclosure with at least one first bendable element coupled to the first enclosure. The thin film may comprise a conductive layer and a first electret layer over a first surface of the conductive layer. The thin film is configured to be bendable. The first enclosure have a first electrode layer as part of the first enclosure. The first enclosure is provided over the first electret layer with the first electrode layer being spaced apart from the first electret layer. The first electrode layer is coupled with a first terminal of an audio signal input. The thin film is configured to interact with the first enclosure in response to audio signals supplied by the audio signal input and to generate sound waves.

27 Claims, 5 Drawing Sheets

FLEXIBLE ELECTRET ACTUATORS AND METHODS OF MANUFACTURING THE SAME

INCORPORATION BY REFERENCE

U.S. Provisional Patent Application No. 61/035,300, titled "Electret Materials, Electret Speakers, and Methods of Manufacturing the Same" is incorporated by reference herein.

BACKGROUND OF THE INVENTION

1. Field of the Invention

This invention relates to actuators, and more particularly, to flexible electret actuators and methods of manufacturing the same.

2. Background of the Invention

In the recent years, there have been continued developments for electronic products. One design concept for those developments has been providing lightweight, thin, portable, and/or small devices. In this regard, flexible electronic technology has been increasingly used in various applications, such as LCDs, flex circuits and flexible solar cells. Applications for flexible electronics, such as flexible speakers, may benefit from their low profile, reduced weight, and/or low manufacturing cost.

A loudspeaker may produce sound by converting electrical signals from an audio amplifier into mechanical motions. Moving-coil speakers are widely used currently, which may produce sound from the forward and backward motions of a cone that is attached to a coil of wire suspended in or movably coupled with a magnetic field. A current flowing through the coil may induce a varying magnetic field around the coil. The interaction of the two magnetic fields causes relative movements of the coil, thereby moving the cone back and forth. This compresses and decompresses the air, and thus generating sound waves. Due to structural limitations, moving-coil speakers are less likely to be made flexible or in a low profile.

An electrostatic speaker may operate on the principle of Coulomb's law that two conductors with equal and opposite charge may generate a push-pull force between them. The push-pull electrostatic force may cause vibration of a diaphragm, thereby generating sound. An electrostatic speaker may include two porous electrodes and a diaphragm placed between the electrodes to form a series of capacitors. The electrodes and the diaphragm may be separated by dielectric materials. The low-profile and lightweight diaphragm makes the electrostatic speaker superior to other types of speakers, such as dynamic, moving-coil or piezoelectric speakers, with respect to its transition response, expansion capability in high frequency, smoothness of sound, acoustic fidelity and low distortion.

With the simple structure, electrostatic speakers may be manufactured in various sizes to accommodate increasing demands for small and thin electronic devices. However, some electrostatic speakers may require a DC-DC converters for providing high voltage to the speakers. Considering the size, cost and power consumption of DC-DC converters, some electret materials have been developed to reduce or avoid the need of DC-DC converters.

FIG. 1 illustrates an exemplary electret speaker, which may include porous electrodes 110*a* and 110*b* with a number of holes 112*a* and 112*b* on each electrode having a porosity of at least 30 percent. The electrodes 110*a* and 10*b* may be made of metals or plastic materials coated with a conductive film. The holes 112*a* and 112*b* may be provided for allowing sound waves to pass through them. The electret speaker may further include a diaphragm 120, which may include a conductive layer 122 sandwiched between electret layers 124*a* and 124*b*. The electret layers 124*a* and 124*b* may store positive or negative charges. The electrodes 110*a* and 110*b*, and diaphragm 120 may be held in place by holding members 130*a* and 130*b*. Elements 140*a*, 140*b*, 142*a* and 142*b* may be made of insulating materials and may be used for separating the diaphragm 120 from the electrode plates 110*a* and 110*b* to form cavities 150*a* and 150*b* for the diaphragm 120 to vibrate.

In operating of an electret speaker of FIG. 1, each signal source 160*a* and 160*b* may output equal and opposite alternating signals to the electrodes 110*a* and 110*b* via conductive lines 162*a* and 162*b*. The signals may cause a time-varying electric field to develop between the electrodes 110*a* and 110*b* and the electret layers 124*a* and 124*b*, thus resulting in a push-pull force. The push-pull force may cause the diaphragm 120 to vibrate, resulting in sound waves that may pass through holes 112*a* and 112*b*.

BRIEF SUMMARY OF THE INVENTION

One example consistent with the invention provides a flexible actuator that may comprise a thin film and at least one first enclosure with at least one first bendable element coupled to the first enclosure. The thin film may comprise a conductive layer and a first electret layer over a first surface of the conductive layer. The thin film is configured to be bendable. The first enclosure has a first electrode layer as part of the first enclosure. The first enclosure is provided over the first electret layer with the first electrode layer being spaced apart from the first electret layer. The first electrode layer is coupled with a first terminal of an audio signal input. The thin film is configured to interact with the first enclosure in response to audio signals supplied by the audio signal input and to generate sound waves.

In another example consistent with the invention, a flexible actuator may comprise a thin film and at least one first enclosure with at least one first bendable element coupled to the first enclosure. The thin film may comprise a conductive layer. The thin film is configured to be bendable. The first enclosure has a first electrode layer and a first electret layer as part of the first enclosure. The first electrode layer is coupled with a first terminal of an audio signal input. The thin film is configured to interact with the first enclosure in response to audio signals supplied by the audio signal input and to generate sound waves.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The foregoing summary, as well as the following detailed description of the invention, will be better understood when read in conjunction with the appended, exemplary drawings. It should be understood, however, that the invention is not limited to the precise arrangements and instrumentalities shown.

In the drawings.

DETAILED DESCRIPTION OF THE INVENTION

Figure 1:
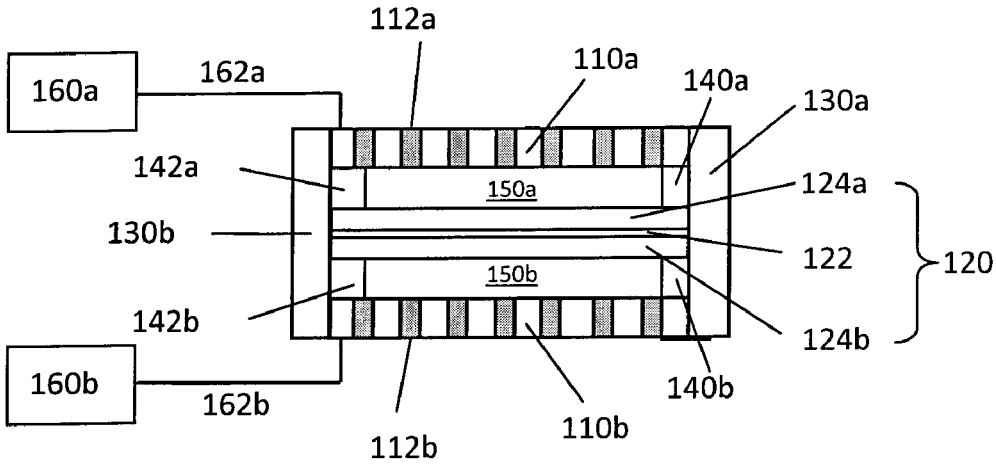
FIG. 1 is a sectional view of an exemplary electret speaker in the prior art.
Figure 2:
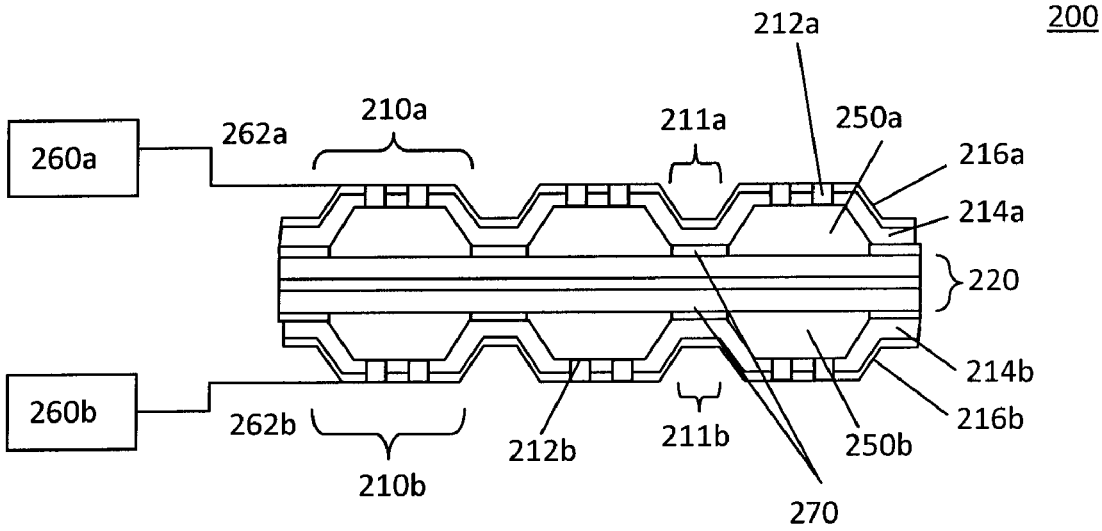
FIG. 2 is a sectional view of an exemplary flexible electret actuator in examples consistent with the present invention.

FIG. 2 illustrates an exemplary flexible electret actuator in examples consistent with the present invention. Referring to FIG. 2, the flexible electret actuator 200 may comprise first enclosures 210*a*, a first bendable elements 211*a*, second enclosures 210*b*, second bendable elements 211*b* and an electret diaphragm 220. The first enclosures 210*a* and the first bendable elements 211*a* may comprise a first flexible layer 214*a* and a first electrode 216*a*. The second enclosures 210*b* and the second bendable elements 211*b* may comprise a second flexible layer 214*b* and a second electrode 216*b*. The flexible layers 214*a* and 214*b* may be made of plastic materials with plasticity or blended fibers. In one example, the flexible layers 214*a* and 214*b* may be made of metal meshes or thin metal plates. The thickness of each flexible layer 214*a* and 214*b* may be in a range of about 20 micrometers to about 10,000 micrometers. The flexible layers 214*a* and 214*b* may be made by at least one of the processes, including but not limited to, injection molding, pressing, forging, plastic thermoforming, mechanical manufacturing and continuous roll-to-roll processes. The first and second electrodes 216*a* and 216*b* may be made from conductive materials such as gold, silver, aluminum, copper, chromium, platinum, indium tin oxide (ITO), silver paste, carbon paste or other conductive materials, or a combination of some of them. The thickness of each electrode 216*a* and 216*b* may be in a range of about 0.01 micrometers to about 100 micrometers. The first and second electrodes 216*a* and 216*b* may be coated on the first and second flexible layers 214*a* and 214*b* by, for example, spraying-coating, spin-coating, dip-coating, sputtering, evaporation, electroplating or a screen-printing process. When the flexible layers 214*a* and 214*b* may be made of metal meshes or thin metal plates to remove the need for the first and second electrodes 216*a* and 216*b* in some examples.

Figure 3:
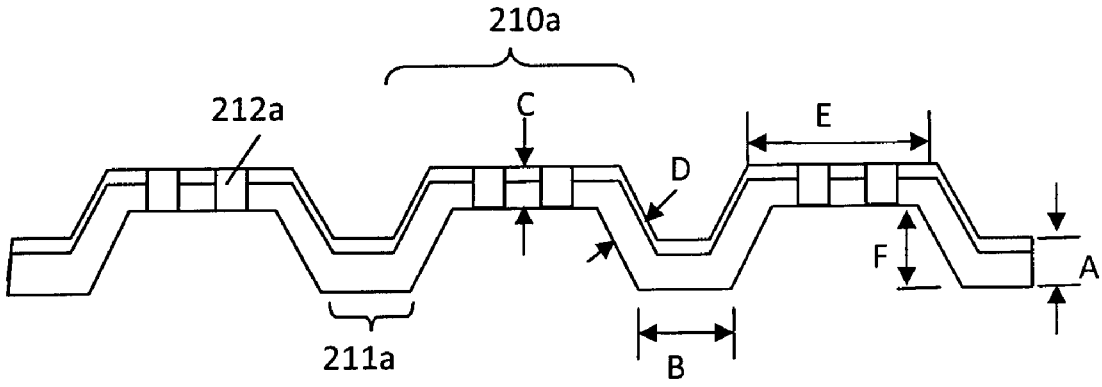
FIG. 3 is a detailed section view of portions of an exemplary flexible electret actuator in examples consistent with the present invention.

FIG. 3 shows details of the first enclosures 210*a* and the first bendable elements 211*a*. Note that the second enclosures 210*b* and second bendable element 211*b* may have corresponding configuration as described below. Each first enclosure 210*a* may have an upper portion with a width C, side portions with a width D and a number of acoustic holes 212*a* on the upper portion. The upper portion and the side portions of each first enclosure 210*a* may provide a cavity 205*a* ((圖 3 未標示?) with a width E and a length F. Each first bendable element 211*a* with a width B may have a thickness of A. The first bendable element 211*a* maybe made of bendable materials while the upper portion and the side portions of the first enclosures 210*a* may be made of rigid materials. As such, when the flexible electret actuator 200 is bent, the length F of the cavity 250*a* defined by the upper portion and the side portions remains the same. In other words, the first enclosures are substantially rigid to limit spacing variation between each first enclosure and the thin film area covering by the first enclosures when the flexible actuator is bent.

Figure 4:
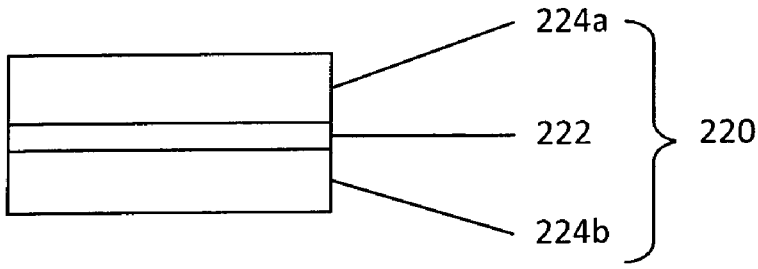
FIG. 4 is a detailed section view of portions of an exemplary flexible electret actuator in examples consistent with the present invention.

FIG. 4 shows the electret diaphragm 220 which may include a conductive layer 222, a first electret layer 224*a* and a second electret layer 224*b*. The conductive layer 222 may be made of gold, silver, aluminum, copper, chromium, platinum, indium tin oxide (ITO), silver paste, carbon paste or other conductive materials, or a combination of some of them. The conductive layer 222 may be coated on the electret layer 224*b* by, for example, spraying-coating, spin-coating, dip-coating, sputtering, evaporation, electroplating or a screen-printing process. In one example, the electret layers 224*a* and 224*b* may be made of at least one of the following materials: fluorinated ethylene propylene (FEP), poly tetrafluoroethylene (PTFE), cyclic olefin copolymer (COC), polychlorotrfluoroethylene (PCTFE), poly(ethylene-tetrafluoroethylene) (ETFE), Teflon AF, polyimide (PI), polyetherimide (PEI), polystyrene (PS), polycarbonate (PC), polymethylmethacrylate (PMMA), polyvinyl chloride (PVC), and tetrafluoroethylene-per-fluoromethoxyethylene copolymer (PFA). The electret layers 224*a* and 224*b* may store either positive charges or negative charges. The electret layers 224*a* and 224*b* may improve its charge storage stability by corona charge. The electret-metal-electret structure of the diaphragm 220 may be fabricated by a conventional process. In one example, the electret layer 224*a* may be formed on the conductive layer 222 and the electret layer 224*b* through vacuum thermal compression, ultrasonic pressing, mechanical compression or a roll-to-roll process to form an electret-metal-electret structure.

Figure 8:
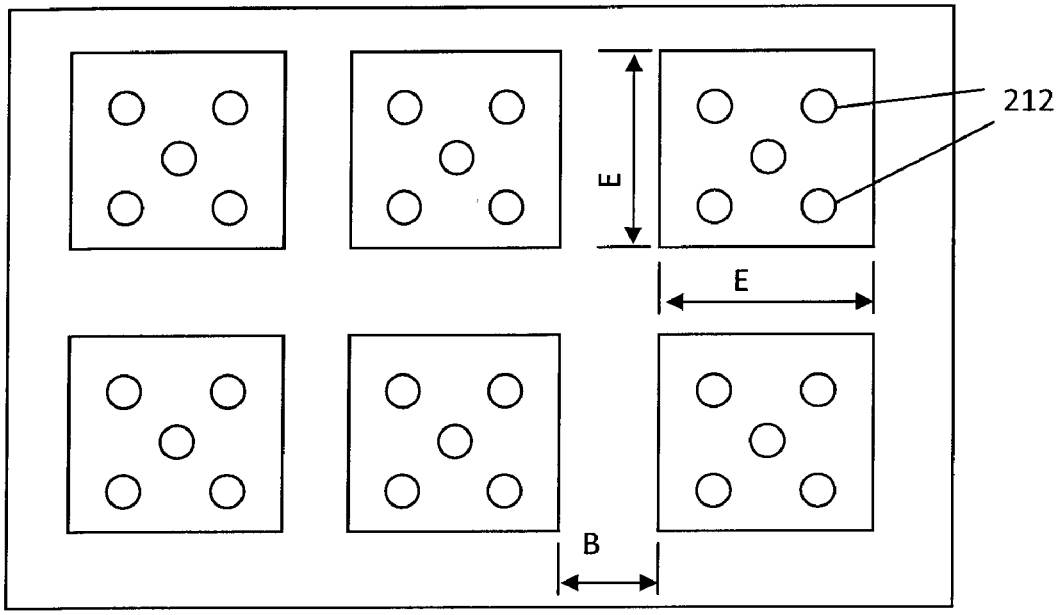
FIG. 8 is a top view of an exemplary application of an exemplary flexible electret actuator in examples consistent with the present invention.
Figure 9:
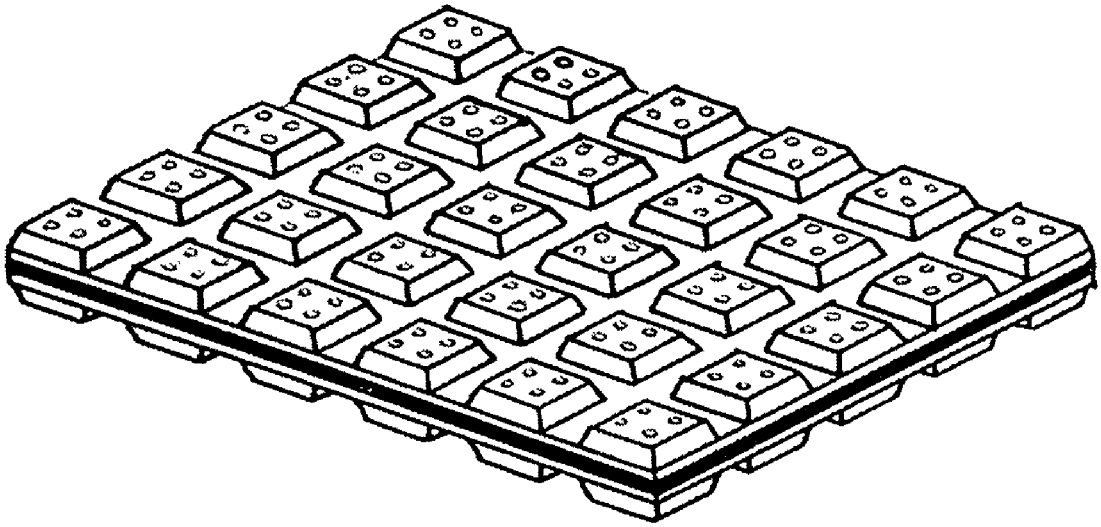
FIG. 9 is a side view of an exemplary application of an exemplary flexible electret actuator in examples consistent with the present invention.

The electret diaphragm 220 may be placed between the first enclosures 210*a* and the second enclosures 210*b* by a process, such as a roll-to-roll pressing process or a large-area imprinting process. In that regard, the electret-metal-electret structure of the diaphragm 220 may be affixed to portions of the first bendable elements 211*a* and the second bendable elements 211*b*. In one example, the diaphragm 220 may be affixed to the first and second enclosures 210*a* and 210*b* by, for example, a thermal pressing process, ultrasonic pressing process, vacuum thermal compression, a roll-to-roll process or mechanical compression. In another example, the diaphragm 220 may be affixed to the first and second enclosures 210*a* and 210*b* by an adhesive element 270 (as shown in FIG. 2). In one example, the adhesive element 270 may be a double-sided adhesive tape, epoxy resin or instant adhesive glues. The first and second bendable elements 211*a* and 211*b* may hold and support the diaphragm 220 to provide its tension. Referring again to FIG. 2, the first enclosure 210*a*, the second enclosure 210*b* and the diaphragm 220 together provide a first cavity 250*a* and a second cavity 250*b* to ensure the efficiency of the diaphragm 220 and its displacement. The assembly of the first and second enclosures 210*a* and 210*b* and the diaphragm 220 may form a single unit of a flexible electret actuator 200. A number of the units arranged together may constitute a flexible electret actuator as shown in FIGS. 8 and 9.

In operation of a flexible electret actuator 200 of FIG. 2, each signal source 260*a* and 260*b* may output an equal and opposite alternating signal to the electrodes 216*a* and 216*b* via conductive lines 262*a* and 262*b*. The signals may cause a time-varying electric field to develop between the electrodes 216*a* and 216*b* and the electret layers 224*a* and 224*b*, thus resulting in a push-pull force. The push-pull force may cause the diaphragm 220 to vibrate. The resultant sound waves may pass through holes 212*a* and 212*b* and thus generating sound.

Figure 5:
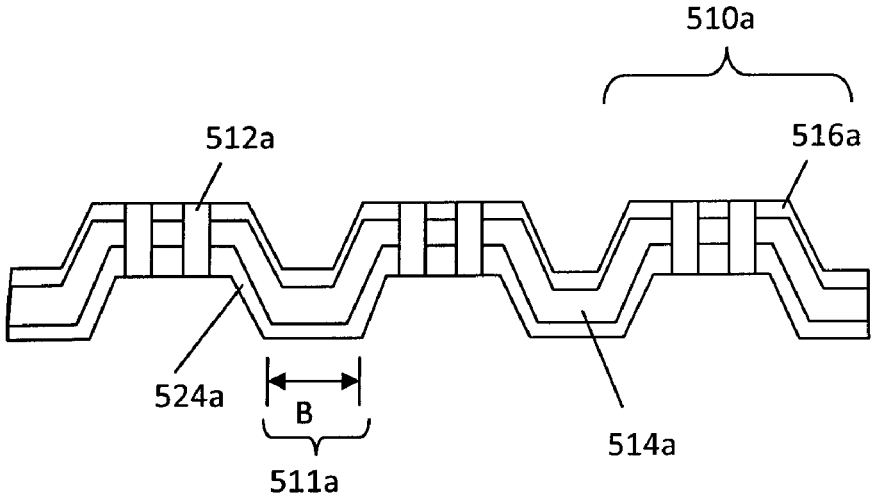
FIG. 5 is a sectional view of an exemplary flexible electret actuator in examples consistent with the present invention.
Figure 6:
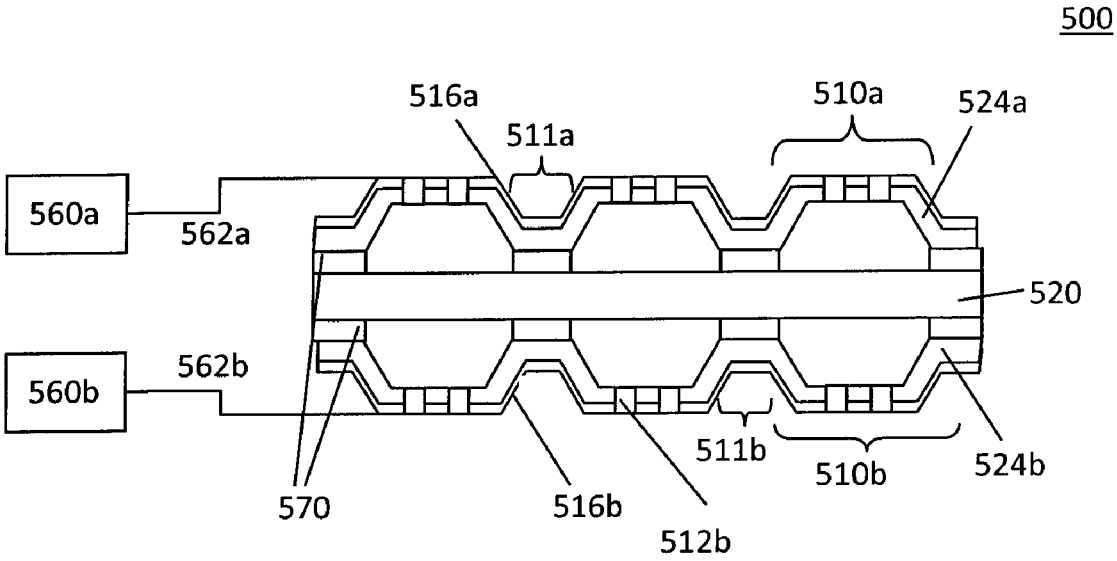
FIG. 6 is a sectional view of an exemplary flexible electret actuator in examples consistent with the present invention.

Another example consistent with the present invention provides a flexible electret actuator wherein the electret layer is included as part of the first enclosures and the first bendable element. In this example, a flexible electret actuator may include first enclosures 510*a*, first bendable elements 511*a*, second enclosures 510*b* and second bendable elements 511*b*. FIG. 5 shows details of the first enclosures 510*a* which may include an electrode 516*a*, a flexible layer 514*a*, an electret layer 524*a*, and acoustic holes 512*a*. Since the flexible layer 514*a*, the electret layer 524*a*, the electrode 516*a* and the acoustic holes 512*a* are same as those corresponding elements described in connection with FIGS. 2-4, description of these elements will not be repeated. In this example, the electret layer 524*a* may be provided under the flexible layer 514*a* by at least one of the processes, including spraying, ultrasonic pressing process, thermal pressing process or mechanical compression. When the electret layer 524*a* is made of plastic with plasticity, the flexible layer 514*a* may be omitted as shown in FIG. 6. In the examples of FIGS. 5 and 6, the electrostatic charges stored in electret layers 524*a* and 524*b* may be positive or negative.

Referring to FIG. 6, the diaphragm 520 may be made of at least one of the following materials: fluorinated ethylene propylene (FEP), cyclic olefin copolymer (COC), polyimide (PI), polyetherimide (PEI), polystyrene (PS), polycarbonate (PC), polymethylmethacrylate (PMMA), polyvinyl chloride (PVC), and poly(ethylene terephthalate (PET). The thickness of the diaphragm 520 may be in a range of about 0.5 micrometers to about 200 micrometers. The diaphragm 520 may be coated with a conductive film to form a conductive diaphragm 520 by, for example, a spraying-coating, spin-coating, dip-coating, sputtering, evaporation, electroplating or screen-printing process. In one example, the conductive layer may be gold, silver, aluminum, copper, chromium, platinum, indium tin oxide (ITO), silver paste, carbon paste or other conductive materials.

Referring again to FIG. 6, the conductive diaphragm 520 may be affixed to portions of the first bendable element 511 a and the second bendable element 511*b* in the same way as described in connection with FIGS. 2-4 above. In addition, a flexible electret actuator 500 of FIG. 6 operates the same as described in connection with FIGS. 2-4.

Figure 7:
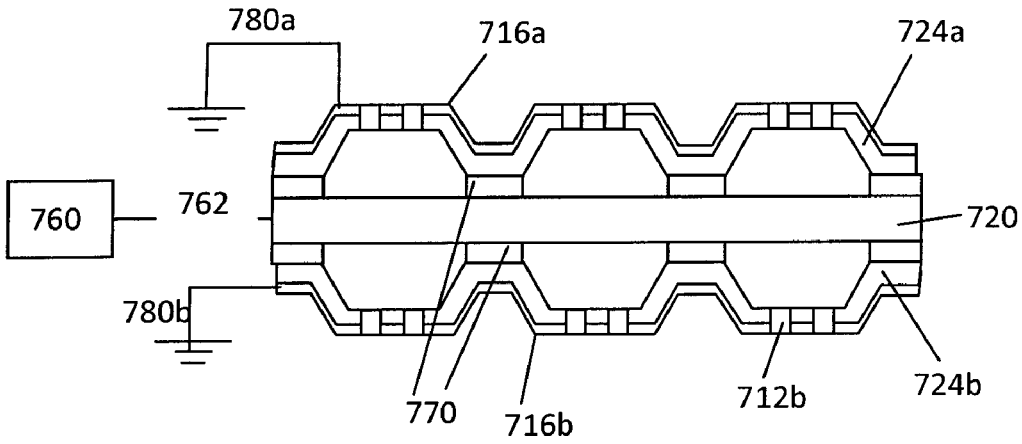
FIG. 7 is a sectional view of an exemplary flexible electret actuator in examples consistent with the present invention.

FIG. 7 illustrates another example in consistent with the present invention. The flexible electret actuator 700 is the same as the flexible electret actuator 500 of FIG. 6 except that one of the electret layers 724*a* and 724*b* stores positive charge and the other stores negative charges. In this example, electrodes 716*a* and 716*b* are connected to ground via conductive lines 780*a* and 780*b*. In operation of a flexible electret actuator of FIG. 7, the signal source 760 may output an alternating signal to the conductive diaphragm 720 via conductive line 762. The signal may cause a time-varying electric field to develop between the conductive diaphragm 720 and the electret layers 724*a* and 724*b*, thus resulting in a push-pull force. The push-pull force may cause the diaphragm 720 to vibrate. The resultant sound waves may pass through holes 712*a* and 712*b* and thus generating sound.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

We claim:

1. A flexible actuator, comprising: a thin film comprising a conductive layer and a first electret layer over a first surface of the conductive layer, the thin film is configured to be bendable; and at least one first enclosure having a plurality of protrusion portions with at least one first bendable element which is conformally coupled onto the first enclosure and being a connecting part of the first enclosure to connect to the thin film, the first enclosure having a first electrode layer and being provided over the first electret layer with the first electrode layer being spaced apart from the first electret layer and a plurality of separated cavities formed between the plurality of protrusion portions and the thin film, the first electrode layer being coupled with a first terminal of an audio signal input, wherein the thin film is configured to interact with the first enclosure in response to audio signals supplied by the audio signal input and to generate sound waves.

2. The flexible actuator of claim 1, wherein the plurality of protrusion portions of the at least one first enclosure is substantially rigid to limit spacing variation between the first enclosure and thin film area covered by the first enclosure when the flexible actuator is bent.

3. The flexible actuator of claim 1, wherein the at least one first enclosure comprises a number of openings for allowing the sound waves to pass through.

4. The flexible actuator of claim 1, wherein the at least one first enclosure is provided over the thin film with an adhesive layer between a portion of the first bendable element and the thin film.

5. The flexible actuator of claim 1, wherein the at least one first enclosure is provided over the thin film by at least one of ultrasonic pressing, thermal pressing, vacuum thermal compression, mechanical compression, and a roll-to-roll process.

6. The flexible actuator of claim 1, wherein the at least one first enclosure and the at least one first bendable element comprise a first flexible layer made of at least one of plastic materials with plasticity and blended fibers at different thicknesses.

7. The flexible actuator of claim 6, wherein the first flexible layer is in a thickness between about 20 micrometers and 10,000 micrometers.

8. The flexible actuator of claim 1, further comprising at least one second enclosure having a plurality of protrusion portions with at least one second bendable element which is conformally coupled onto the second enclosure and being a connecting part of the second enclosure to connect to the thin film, the second enclosure having a second electrode layer and being provided over the thin film at a side opposed to the first enclosure with the second electrode layer being spaced apart from the thin film and a plurality of separated cavities being formed between the plurality of protrusion portions of the second enclosure and the thin film, the second electrode layer being coupled with a second terminal of the audio signal input, wherein the thin film is configured to interact with the first and second enclosures in response to the audio signals supplied by the audio signal input and to generate the sound waves.

9. The flexible actuator of claim 1, further comprising at least one second enclosure having a plurality of protrusion portions with at least one second bendable element which is conformally coupled onto the second enclosure and being a connecting part of the second enclosure to connect to the thin film, the second enclosure having a second electrode layer and being provided over the thin film at a side opposed to the first enclosure with the second electrode layer being spaced apart from the thin film and a plurality of separated cavities being formed between the plurality of protrusion portions of the second enclosure and the thin film, the second electrode layer being coupled with a terminal of a second audio signal input, wherein the thin film is configured to interact with the first and second enclosures in response to the audio signals supplied by the audio signal input and the second audio signal input and to generate the sound waves.

10. The flexible actuator of claim 1, wherein the first electrode layer is in a thickness between about 0.01 micrometers and 100 micrometers.

11. The flexible actuator of claim 1, wherein the conductive layer is made of at least one of gold, silver, aluminum, copper, chromium, platinum, indium tin oxide (ITO), silver paste, carbon paste and other conductive materials.

12. The flexible actuator of claim 1, wherein the first electret layer is made of at least one of fluorinated ethylene proylene (FEP), poly tetrafluoroethylene (PTFE), cyclic olefin copolymer (COC), polychlorotrfluoroethylene (PCTFE), poly(ethylene-tetrafluoroethylene) (ETFE), Teflon AF, polyimide (PI), polyetherimide (PEI), polystyrene (PS), polycarbonate (PC), polymethylmethacrylate (PMMA), polyvinyl chloride (PVC), and tetrafluoroethylene-per-fluoromethoxyethylene copolymer (PFA).

13. The flexible actuator of claim 1, wherein the thin film further comprises a second electret layer over a second surface of the conductive layer, wherein the conductive layer is sandwiched between the first electret layer and the second electret layer to form an electret-metal-electret structure.

14. A flexible actuator, comprising: a thin film comprising a conductive layer, the thin film being configured to be bendable; at least one first enclosure provided over the thin film with at least one first bendable element coupled to the first enclosure, the first enclosure having a first electrode layer and a first electret layer as part of the first enclosure with the first electret layer being an inner part, the first enclosure being coupled with a first terminal of an audio signal input, wherein the thin film is configured to interact with the first enclosure in response to audio signal supplied by the audio signal input and to generate sound waves.

15. The flexible actuator of claim 14, wherein the at least one first enclosure is substantially rigid to limit spacing variation between the first enclosure and thin film area covered by the first enclosure when the flexible actuator is bent.

16. The flexible actuator of claim 14, wherein the at least one first enclosure comprises a number of openings for allowing the sound waves to pass through.

17. The flexible actuator of claim 14, wherein the at least one first enclosure is provided over the thin film with an adhesive layer between a portion of the first bendable element and the thin film.

18. The flexible actuator of claim 14, wherein the at least one first enclosure is provided over the thin film by at least one of ultrasonic pressing, thermal pressing, vacuum thermal compression, mechanical compression, and a roll-to-roll process.

19. The flexible actuator of claim 14, wherein the at least one first enclosure and the first bendable element comprise a first flexible layer made of at least one of plastic materials with plasticity and blended fibers at different thicknesses.

20. The flexible actuator of claim 19, wherein the first flexible layer is in a thickness between about 20 micrometers and 10,000 micrometers.

21. The flexible actuator of claim 14, further comprising at least one second enclosure with at least one second bendable element coupled to the second enclosure, the second enclosure being provided over the thin film at a side opposed to the first enclosure, the second enclosure having a second electrode layer and at least one second electret layer as part of the second enclosure with the second electret layer being an inner part, the second electrode layer being coupled with a second terminal of the audio signal input, wherein the thin film is configured to interact with the first and second enclosures in response to the audio signals supplied by the audio signal input and to generate the sound waves.

22. The flexible actuator of claim 14, further comprising at least one second enclosure with at least one second bendable element coupled to the second enclosure, the second enclosure being provided over the thin film at a side opposed to the first enclosure, the second enclosure having a second electrode layer and at least one second electret layer as part of the second enclosure with the second electret layer being an inner part, the second electrode layer being coupled with a terminal of a second audio signal input, wherein the thin film is configured to interact with the first and second enclosures in response to the audio signals supplied by the audio signal input and the second audio signal input and to generate the sound waves.

23. The flexible actuator of claim 14, wherein the first electrode layer is in a thickness between about 0.01 micrometers and 100 micrometers.

24. The flexible actuator of claim 14, wherein the conductive layer of the thin film is coupled with a second terminal of the audio signal input.

25. The flexible actuator of claim 14, wherein the conductive layer is made of at least one of gold, silver, aluminum, copper, chromium, platinum, indium tin oxide (ITO), silver paste, carbon paste and other conductive materials.

26. The flexible actuator of claim 14, wherein the first electret layer is made of at least one of fluorinated ethylene proylene (FEP), poly tetrafluoroethylene (PTFE), cyclic olefin copolymer (COC), polychlorotrfluoroethylene (PCTFE), poly(ethylene-tetrafluoroethylene) (ETFE), Teflon AF, polyimide (PI), polyetherimide (PEI), polystyrene (PS), polycarbonate (PC), polymethylmethacrylate (PMMA), polyvinyl chloride (PVC), and tetrafluoroethylene-per-fluoromethoxyethylene copolymer (PFA).

27. The flexible actuator of claim 14, wherein the at least one first enclosure has a plurality of protrusion portions which provides a plurality of separated cavities formed between the plurality of protrusion portions and the thin film.

* * * * *